US006045426A

United States Patent [19]

Wang et al.

[11] Patent Number: 6,045,426

[45] Date of Patent: Apr. 4, 2000

[54] METHOD TO MANUFACTURE FIELD EMISSION ARRAY WITH SELF-ALIGNED FOCUS STRUCTURE

[75] Inventors: Chi-Hua Wang, Hsin-Chu; Chao-Chi Peng, Hsinchu, both of Taiwan

[73] Assignee: Industrial Technology Research Institute, Hsin-Chu, Taiwan

[21] Appl. No.: 09/373,248

[22] Filed: Aug. 12, 1999

[51] Int. Cl.[7] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 5,186,670 | 2/1993 | Doan et al. | 445/24 |
| 5,649,847 | 7/1997 | Haven | 445/24 |
| 5,710,483 | 1/1998 | Peng | 313/497 |
| 5,757,138 | 5/1998 | Tsai | 315/169.3 |
| 5,920,151 | 7/1999 | Barton et al. | 445/24 |

*Primary Examiner*—Kenneth J. Ramsey

*Attorney, Agent, or Firm*—George O. Saile; Stephen B. Ackerman

[57] ABSTRACT

A process for forming self-aligned focus electrodes in an FED display is described. The process begins by forming cathode columns and gate lines in the normal way, care being taken to ensure that at the intersections between these two sets of lines (where the emitter cavities will reside) the material comprising the cathode columns is transparent to light that will expose photoresist. To this end, ITO is used with an overlay of amorphous silicon in areas well away from the intersections. With cathode and gate lines in place, a second dielectric layer is deposited and material for the focus electrodes is laid down, said material also being transparent as well as conductive, a preferred choice being ITO. Photoresist is then laid down over the upper ITO layer but, in a departure from normal practice, it is exposed to light coming from the bottom of the substrate. Thus, the gate lines act as shadow masks for exposing the photoresist on the top ITO layer, resulting in perfect alignment of the focus lines with the gate lines, cathode columns, and emitter cavities (after etching). The final step is the formation of the microtips inside the emitter cavities in the usual way.

20 Claims, 3 Drawing Sheets

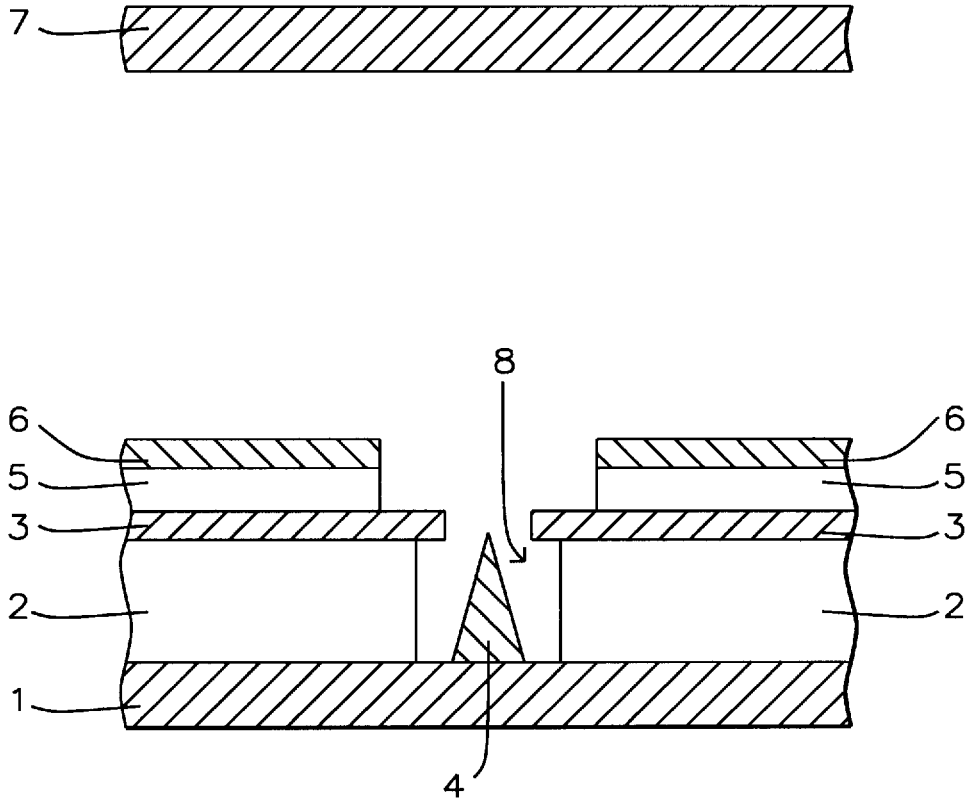
FIG. 1 – Prior Art
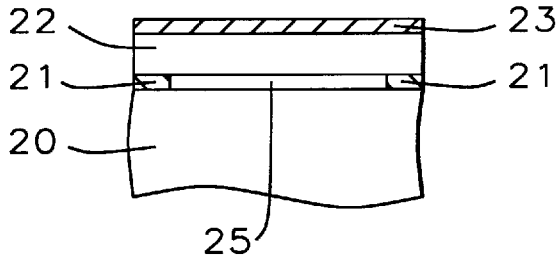
FIG. 2

METHOD TO MANUFACTURE FIELD EMISSION ARRAY WITH SELF-ALIGNED FOCUS STRUCTURE

FIELD OF THE INVENTION

The invention relates to the general field of field emission devices with particular reference to focusing electrodes and methods for their alignment.

BACKGROUND OF THE INVENTION

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines and is orthogonally disposed relative to them, intersecting with them at the locations of the conical emitters or microtips, and connected to a source of positive voltage. Both the cathode and the gate line that relate to a particular microtip must be activated before there will be sufficient voltage to cause cold cathode emission.

The electrons that are emitted by the cold cathodes accelerate past openings in the gate lines and strike an electroluminescent panel that is located a short distance from the gate lines. In general, a significant number of microtips serve together as a single pixel (or subpixel) for the total display. Note that, even though the local electric field in the immediate vicinity of a microtip is in excess of 1 million volts/cm., the externally applied voltage is only of the order of 100 volts.

In FIG. 1 we show, in schematic cross-section, the basic elements of a typical cold cathode display. Metallic lines 1 are formed on the surface of an insulating substrate (not shown). Said lines are referred to as cathode columns. At regular intervals along the cathode columns, microtips 4 are formed. These are typically cones of height about one micron and base diameter about one micron and comprise molybdenum or silicon, though other materials may also be used. In many embodiments of the prior art, local ballast resistors (not shown here) may be in place between the cones and the cathode columns.

Metallic lines 3 are formed at right angles to the cathode columns, intersecting them at the locations of the microtips. A layer of insulation 2 supports lines 3, which are generally known as gate lines, placing them at the top level of the microtips, that is at the level of the apexes of the cones 4. Openings in gate lines 3, directly over emitter cavity 8 in which the microtips are located, allow streams of electrons to emerge from the tips when sufficient voltage is applied between the gate lines and the cathode columns. Because of the local high fields right at the surface of the microtips, relatively modest voltages, of the order of 100 volts are sufficient.

After emerging from the emitter cavity, electrons are further accelerated so that they strike fluorescent screen 7 where they emit visible light. Said fluorescent screen is separated from the cold cathode assembly by spacers (not shown) and the space between these two assemblies is evacuated to provide and maintain a vacuum of the order of $10^{-7}$ torr.

It should be noted that, although the electrons are accelerated past the gate (or extraction) electrode, they are also attracted to the gate as they pass it. This arrangement (referred to as proximity focusing) leads to the formation of a diverging beam and results in a relatively large spot size at the surface of the phosphor screen. A common method of dealing with this is to add to the structure an additional, focusing, electrode similar to the gate electrode but located above it. This is illustrated in FIG. 1 where focus electrode 6 is shown as concentric with and positioned above extraction electrode 3, being separated therefrom by dielectric layer 5. The focus electrode is biased negative relative to the gate (being at or near cathode potential) so that the electron beam, as it passes through it, tends to be compressed and becomes less diverging.

There are two difficulties associated with the focus gate approach. (i) Since electrons are being repelled as they pass through it and because the effectiveness of the gate electrode is reduced by its presence, the focus gate arrangement brings about the requirement of higher gate voltages to achieve the same beam densities. This can cause a problem with breakdown in layer 2. (ii) The requirement that gate and focus electrodes must be precisely aligned relative to one another makes the manufacturing of this arrangement more prone to error and therefore more expensive. The present invention is directed to solving problem (ii)—how to guarantee perfect alignment between the gate and focus electrodes every time.

During a routine search of the prior art no references offering the same solution as the present invention were found. Several references of interest were however encountered. For example, Peng (U.S. Pat. No. 5,710,483) uses a micro-mesh to provide additional focusing of the extracted electrons. However, no attempt is made to bring about close alignment between openings in the micro-mesh and the emitter micro-tips.

Tsai (U.S. Pat. No. 5,757,138) teaches a focusing aperture that is maintained at cathode potential and including a current limiting resistor (to protect against microtip to gate shorts) which is best located electrically close to the microtip. Doan et al. (U.S. Pat. No. 5,186,670) does teach a self aligned gate and focusing ring structure. After microtip formation, several alternating layers of metal and insulation are deposited and a hole is then etched to form gate and focus openings as well as to expose the tip. This method guarantees perfect alignment between the gate and focus electrodes but has the disadvantage that misalignment between both these electrodes and the microtip is still possible.

SUMMARY OF THE INVENTION

It has been an object of the present invention to provide a process for forming an array of field emission devices wherein there is perfect alignment between focus electrodes, gate electrodes, cathode columns, and microtips.

Another object of the invention has been that said process be fully compatible with existing methods for the manufacture of FED displays and be of comparable cost.

These objects and been achieved by first forming cathode columns and gate lines in the normal way, care being taken to ensure that at the intersections between these two sets of lines (where the emitter cavities will reside) the material comprising the cathode columns is transparent to light that could expose photoresist. To this end, ITO is used with an overlay of amorphous silicon in areas well away from the intersections. With cathode and gate lines in place, a second dielectric layer is deposited and material for the focus electrodes is laid down, said material also being transparent while the same time being conductive, a preferred choice being ITO. Photoresist is then laid down over the upper ITO layer but, in a departure from normal practice, it is exposed to light coming from the bottom of the substrate. Thus, the gate lines act as shadow masks for exposing the photoresist on the top ITO layer, resulting in perfect alignment of the focus lines with the gate lines, cathode columns, and emitter cavities (after etching). The final step is the formation of the microtips inside the emitter cavities in the usual way.

BRIEF DESCRIPTION OF THE DRAWINGS

FIG. 1 illustrates an FED, including a focus electrode which, under the methods of the prior art, is subject to misalignment.

FIG. 2 illustrates the starting point for the process of the present invention—the deposition of material suitable for the formation of cathode columns and gate lines.

DESCRIPTION OF THE PREFERRED EMBODIMENTS

Figure 3:
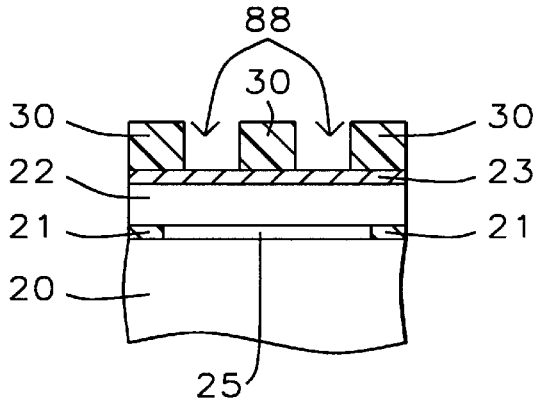
FIGS. 3 and 4 illustrates the etching process for forming the gate lines and the emitter cavities.

We begin our description of the process of the present invention by referring to FIG. 2. Shown there is transparent substrate 20, with 'transparent' referring to the transmission of radiation that is suitable for exposing photoresist, in particular positive photoresist. Typical materials for the substrate would be glass or silica.

A layer 25 of indium-tin oxide (ITO) or similar transparent conducting material such as indium, tin, zinc, or cadmium oxide, indium zinc oxide, or cadmium stannate is deposited over the entire surface to a thickness of between about 0.1 and 0.4 microns. For ITO, layer 25 has a sheet resistance of between about 5 and 20 ohms per square. To reduce this to some extent a layer of amorphous silicon 21 is then deposited over layer 25 but is removed from selected areas where it will later be necessary to transmit radiation used for exposing photoresist. Amorphous silicon layer 21 is between about 0.1 and 0.5 microns thick so that, where combined with ITO layer 25, the sheet resistance was between about 100 k and 100M ohms per square.

In the course of patterning and etching the amorphous silicon, both it and ITO 25 were formed into a series of parallel cathode columns running across the full length of the substrate. This was followed by the deposition of transparent dielectric layer 22 to a thickness of between about 0.5 and 2 microns. As before, 'transparent' refers to the transmission of radiation suitable for exposing photoresist. Our preferred material for layer 22 has been silicon oxide.

The next step was to deposit conductive layer 23, between about 0.1 and 0.6 microns thick, onto the surface of dielectric layer 22. Layer 23 is required to be opaque to radiation that could expose photoresist. Our preferred material for layer 23 has been MoW (molybdenum tungstide) but other materials such as molybdenum or niobium could also have been used.

Figure 4:
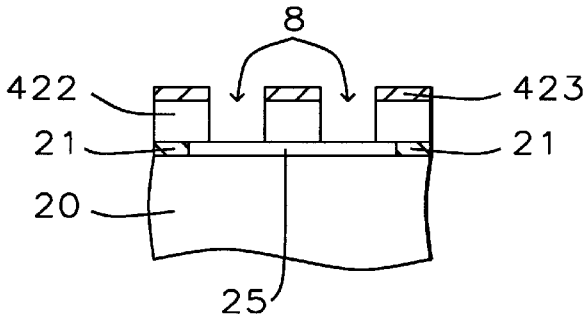

Referring now to FIG. 3, layer 23 was then coated with photoresist which was then exposed through a suitable imaging system and developed to produce resist mask 30 which defined the pattern of the gate lines, including openings 88 which defined the future positions of the emitter cavities so that, after plasma etching for between about 0.5 and 2 minutes at a temperature between about 25 and 50° C., a series of gate lines 423 were formed, said gate lines being orthogonally disposed relative to the cathode columns. The selected areas mentioned earlier (those limited to ITO) were located at the intersections of the gate and cathode lines, including the emitter cavity openings 8, as illustrated in FIG. 4. Layer 422 is layer 22 after the etching has taken place.

Figure 5:
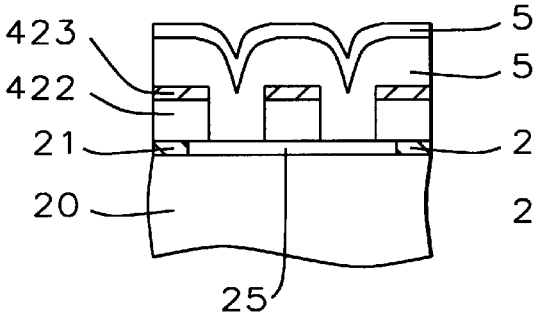
FIG. 5 illustrates the deposition of a dielectric layer, followed by a layer of ITO, for filling the emitter cavities and providing a separation layer for the focus electrode.

Referring now to FIG. 5, a second transparent dielectric layer 55 was then deposited over the full surface by means of CVD (chemical vapor deposition) ensuring a reasonably conformal coating that filled openings 8 without trapping any voids. Layer 55 had a thickness between about 0.1 and 1 microns. As before, our preferred material for layer 55 has been silicon oxide. This was followed by the deposition of second layer of ITO 56, having a thickness between about 0.1 and 0.4 microns and a sheet resistance between about 5 and 20 ohms per square. As was the case for the first ITO layer, layer 56 was also deposited by means of sputtering.

Figure 6:
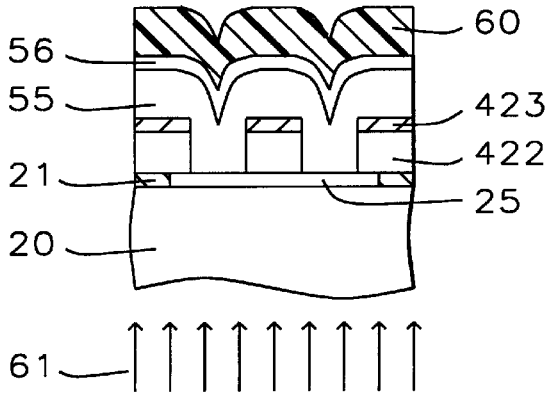
FIG. 6 illustrates a key feature of the invention which is the back side exposure of photoresist which has been coated on top side of the structure.

As shown in FIG.6, layer 56 was then coated with a layer of positive photoresist 60. Next, as a key feature of the invention, parallel light beam 61 was directed to pass through the substrate (i.e. from the back side) to photoresist 60, passing en route through layers 55 and 56 but being blocked by opaque conductor 423 which thus acted as a shadow mask for exposure of photoresist layer 60.

Figure 7:
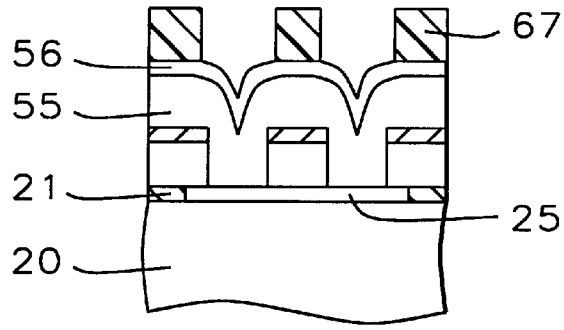
FIGS. 7 and 8 show how the emitter cavities are re-formed by etching at the same time that the focus electrodes are formed.
Figure 8:
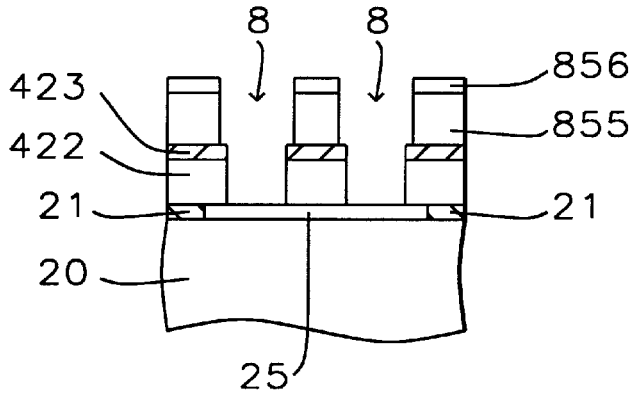

After development, the photoresist became etch resistant mask 67 as illustrated in FIG. 7, said mask being in perfect alignment with cathode columns 21/25 as well as with emitter cavities 8 (re-formed as part of the etching process). Said etch process was effected using either wet etching (an aqueous solution of nitric and hydrochloric acids) or dry etching (chlorine gas) at between about 25 and 70° C. for between about 1 and 10 minutes. After the etching of layers 55 and 56 the structure had the appearance shown in FIG. 8, with said layers now being designated as 855 and 856 respectively.

Figure 9:
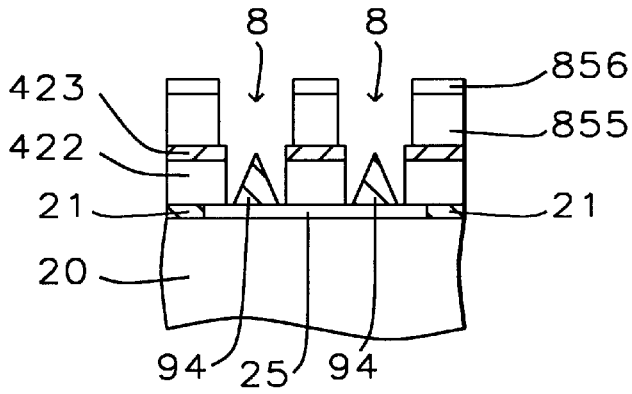
FIG. 9 shows the final structure including the presence of microtips in the emitter cavities.

After removal of photoresist 67, the final step in the process was the formation of microtips 94, as shown in FIG. 9. Standard procedures were used for doing this so the details will not be given here except to note that since said procedures automatically result in the placement of the microtips in the center of the emitter cavities, the net result of the process that has been described above is perfect alignment between cathode columns, gate lines, gate line openings and microtips every time.

While the invention has been particularly shown and described with reference to the preferred embodiments thereof, it will be understood by those skilled in the art that various changes in form and details may be made without departing from the spirit and scope of the invention.

What is claimed is:

1. A process for manufacturing a field emission array having a self-aligned focus electrode, comprising:

providing a transparent substrate and depositing a thereon a first layer of ITO followed by a layer of amorphous silicon;

patterning and etching said ITO and amorphous silicon layers to form a plurality of cathode columns on the substrate;

patterning and selectively etching the amorphous silicon thereby removing it from selected areas;

depositing a transparent first dielectric layer;

on said first dielectric layer depositing an opaque conductive layer;

patterning and etching said opaque conductive layer to form a plurality of gate lines, orthogonally disposed relative to said cathode columns, whereby the gate lines and cathode columns intersect over said selected areas and emitter cavity openings are formed in the opaque conductive layer;

using the opaque conductive layer as a mask, etching the first dielectric layer down to the level of the ITO, thereby forming emitter cavities;

depositing a transparent second dielectric layer over all surfaces followed by a second layer of ITO;

coating the second ITO layer with a layer of positive photoresist;

directing a beam of parallel light through the substrate thereby causing the layer of opaque conductor to act as a shadow mask for exposure of the photoresist;

developing the photoresist to form an etch resistant mask that is in perfect alignment with said emitter cavities and then etching the second ITO layer and the second dielectric layer down to the level of the first ITO layer, thereby re-forming said emitter cavities;

removing the photoresist; and then forming micro-tips that are centrally located within said emitter cavities.

2. The process of claim 1 wherein the substrate is glass or silica.

3. The process of claim 1 wherein said first ITO layer has a thickness between about 0.1 and 0.4 microns.

4. The process of claim 1 wherein said layer of amorphous silicon has a thickness between about 0.1 and 0.5 microns.

5. The process of claim 1 wherein the first dielectric layer is silicon oxide.

6. The process of claim 1 wherein the first dielectric layer has a thickness between about 0.2 and 2 microns.

7. The process of claim 1 wherein the opaque conductive layer is molybdenum tungstide or molybdenum or niobium.

8. The process of claim 1 wherein the opaque conductive layer has a thickness between about 0.1 and 0.6 microns.

9. Process of claim 1 wherein the second dielectric layer is silicon oxide.

10. The process of claim 1 wherein the second dielectric layer has a thickness between about 0.1 and 1 microns.

11. The process of claim 1 wherein the second layer of ITO has a thickness between about 0.1 and 0.4 microns.

12. A process for manufacturing a field emission array having a self-aligned focus electrode, comprising:

forming cathode columns of a transparent conductive material on a transparent substrate;

forming gate lines of an opaque conductive material, separated from the cathode columns by a transparent dielectric that includes an emitter cavity where the cathode and gate lines intersect; and forming focus lines that include focusing apertures, separated from said gate lines by a layer of a transparent dielectric, said focus lines being in perfect alignment with the cathode columns and said focus apertures being in perfect alignment with the emitter cavities.

13. The process of claim 12 wherein the step of forming focus lines further comprises patterning by means of a layer of positive photoresist that is exposed by a beam of parallel lights directed through the substrate.

14. The process of claim 12 wherein the substrate is glass or silica.

15. The process of claim 12 wherein the transparent conductive material from which the cathode columns are formed is selected from the group consisting of indium-tin oxide, indium oxide, tin oxide, zinc oxide, cadmium oxide, indium zinc oxide, and cadmium stannate.

16. The process of claim 12 wherein the dielectric layer separating the cathode columns and gate lanes has a thickness between about 0.5 and 2 microns.

17. The process of claim 12 wherein the opaque conductive layer is molybdenum tungstide or molybdenum or niobium.

18. The process of claim 12 wherein the opaque conductive layer has a thickness between about 0.1 and 0.6 microns.

19. The process of claim 12 wherein the dielectric layer separating the focus lines and the gate lanes has a thickness between about 0.1 and 1 microns.

20. The process of claim 12 wherein the focus lines are selected from the group consisting of indium-tin oxide, indium oxide, tin oxide, zinc oxide, cadmium oxide, indium zinc oxide, and cadmium stannate.

* * * * *